US009937535B2

(12) United States Patent
Erickson et al.

(10) Patent No.: US 9,937,535 B2
(45) Date of Patent: Apr. 10, 2018

(54) METHOD AND SYSTEM FOR OPERATING A CIP PRE-FLUSH STEP USING FLUOROMETRIC MEASUREMENTS OF SOIL CONTENT

(71) Applicant: Ecolab USA Inc., Saint Paul, MN (US)

(72) Inventors: Anthony Erickson, Minneapolis, MN (US); Peter J. Fernholz, Burnsville, MN (US)

(73) Assignee: Ecolab USA Inc., Saint Paul, MN (US)

( * ) Notice: Subject to any disclaimer, the term of this patent is extended or adjusted under 35 U.S.C. 154(b) by 0 days.

(21) Appl. No.: 13/827,423

(22) Filed: Mar. 14, 2013

(65) Prior Publication Data

US 2014/0261550 A1 Sep. 18, 2014

(51) Int. Cl.

| | |
|---|---|
| ***B08B 9/032*** | (2006.01) |
| ***B08B 9/00*** | (2006.01) |
| ***B08B 9/027*** | (2006.01) |
| ***C11D 11/00*** | (2006.01) |

(52) U.S. Cl.

CPC ..... *B08B 9/0325* (2013.01); *B08B 9/00* (2013.01); *B08B 9/027* (2013.01); *C11D 11/0041* (2013.01); *C11D 11/0076* (2013.01)

(58) Field of Classification Search

None

See application file for complete search history.

(56) References Cited

U.S. PATENT DOCUMENTS

| | | | | |
|---|---|---|---|---|
| 3,350,301 | A * | 10/1967 | Hoffman | 210/705 |
| 5,658,798 | A * | 8/1997 | Bertin | G01N 33/02 436/172 |
| 5,876,960 | A * | 3/1999 | Rosen | 435/39 |
| 6,197,739 | B1 * | 3/2001 | Oakes et al. | 510/392 |
| 7,247,210 | B2 | 7/2007 | Staub et al. | |
| 7,550,746 | B2 * | 6/2009 | Tokhtuev et al. | 250/461.1 |
| 7,614,410 | B2 | 11/2009 | Kenowski et al. | |
| 8,373,140 | B2 | 2/2013 | Tokhtuev et al. | |

(Continued)

FOREIGN PATENT DOCUMENTS

| | | |
|---|---|---|
| CN | 202683568 U | 1/2013 |
| DE | 4234466 A1 | 4/1994 |
| WO | 0138218 A1 | 5/2001 |

OTHER PUBLICATIONS

PCT/US2014/021224, Notification of Transmittal of the International Search Report and the Written Opinion of the International Search Authority dated Jul. 22, 2014, 14 pages.

(Continued)

*Primary Examiner* — Nicole Blan
*Assistant Examiner* — Pradhuman Parihar
(74) *Attorney, Agent, or Firm* — Fredrikson & Byron, P.A.

(57) ABSTRACT

A clean-in-place process may begin with a pre-rinse step in which soil (e.g., contaminants, residual product) is flushed from industrial equipment prior to circulating a cleaning agent through the equipment. To determine when the equipment has been suitably flushed, pre-rinse fluid exiting the industrial equipment and containing soil may be fluorometrically analyzed. A concentration of the soil is determined from fluorescent emissions emitted by the soil itself. Based on this information, the pre-rinse flushing process can be controlled, for example, to minimize water usage, maximize pre-rinse cleaning, or based on any other suitable metric.

18 Claims, 5 Drawing Sheets

(56) References Cited

U.S. PATENT DOCUMENTS

| | | | | |
|---|---|---|---|---|
| 8,614,793 | B2 | 12/2013 | Tokhtuev et al. | |
| 2005/0183744 | A1* | 8/2005 | Staub | B08B 9/0321 134/22.1 |
| 2005/0184008 | A1 | 8/2005 | Schacht et al. | |
| 2006/0046945 | A1* | 3/2006 | Herdt et al. | 510/234 |
| 2006/0286676 | A1* | 12/2006 | Van Camp et al. | 436/172 |
| 2007/0241037 | A1* | 10/2007 | Wang | 210/94 |
| 2008/0105279 | A1 | 5/2008 | Herdt et al. | |
| 2008/0105282 | A1 | 5/2008 | Fernholz et al. | |
| 2010/0229899 | A1* | 9/2010 | Andersen | B08B 3/00 134/34 |
| 2011/0197920 | A1* | 8/2011 | Kenowski | B08B 9/027 134/10 |
| 2011/0260079 | A1 | 10/2011 | Tokhtuev et al. | |

OTHER PUBLICATIONS

European Patent Application No. 14772703.6, Extended European Search Report dated Oct. 28, 2016, 8 pages.

* cited by examiner

METHOD AND SYSTEM FOR OPERATING A CIP PRE-FLUSH STEP USING FLUOROMETRIC MEASUREMENTS OF SOIL CONTENT

TECHNICAL FIELD

This disclosure relates to clean-in-place (CIP) technology and, more particularly, to CIP monitoring.

BACKGROUND

A clean-in-place (CIP) process is a cleaning technique adapted to remove soils from the internal components of industrial equipment, such as processing tanks, fluid lines, pumps, valves, heat exchangers, and other pieces of equipment. A CIP cleaning process cleans the internal surfaces of these components without the need to dismantle any of the components for individual cleaning. Rather, the components can be cleaned by passing a cleaning solution through the components, for example following a fluid path normally traveled by a fluid processed on the equipment, to clean the components.

Because of its ease of use and effectiveness, CIP cleaning processes have found widespread applicability in many different industries, particularly those industries where hygiene and sterility are of particular importance. Example industries that use CIP cleaning processes include dairy, beverage, brewing, processed food preparation, pharmaceuticals, and cosmetics. In these and other industries, internal surfaces of processing equipment can become contaminated with soil during operation. To help ensure the operational efficiency of the processing equipment and to prevent soil buildup from contaminating product produced on the equipment, the processing equipment is periodically cleaned using a CIP process.

The number of cleaning steps performed during a CIP cleaning process can vary depending on the specific process being performed. At minimum, a cleaning solution is passed through the processing equipment before resuming normal processing. Any product subsequently passed through the equipment that becomes contaminated by cleaner residue can be discarded. More typically, a CIP cleaning process involves at least three steps. In the first step, which may be referred to as a pre-flush or pre-rinse step, a fluid such as fresh water is passed through the processing equipment to flush the system of soil (e.g., residual product in the equipment, product build-up on equipment internals). In the second step, which may be referred to as a cleaning step, a chemical solution is passed through the processing equipment to clean and sanitize the equipment. Finally, in the third step, a rinse liquid such as fresh water is passed through the processing equipment to rinse any residual cleaning solution from the equipment.

SUMMARY

In general, this disclosure relates to pre-rinse steps performed in CIP processes, including monitoring and control of a pre-rinse step based on analysis of a pre-rinse fluid. In some examples, industrial equipment is flushed with a pre-rinse fluid during a pre-flush step of a CIP process so as to remove soil from the industrial equipment. Pre-rinse fluid exiting the industrial equipment is fluorometrically analyzed to determine a concentration of the soil in the pre-rinse fluid. For example, light can be emitted into the pre-rinse fluid to cause soil in the fluid to generate fluorescent emissions. The magnitude and/or wavelength of the fluorescent emissions may correspond to the concentration of the soil in the pre-rinse fluid. In some examples, the industrial equipment is flushed with fresh pre-rinse fluid until a fluorometrically determined concentration of soil in the fluid exiting the equipment falls below a threshold value. This may provide an indication that the industrial equipment is suitably flushed. By actively monitoring the pre-rinse fluid exiting the industrial equipment, the extent and duration of the pre-rinse process can be controlled, for example, to minimize water usage, maximize pre-rinse cleaning, etc.

In one example, a method is described that includes flushing industrial equipment with a pre-rinse fluid during a clean-in-place (CIP) process so as to remove soil from the industrial equipment. The example method also includes fluorometrically analyzing the pre-rinse fluid exiting the industrial equipment to determine a concentration of the soil in the pre-rinse fluid.

In another example, a system is described that includes industrial equipment, a fluid pump, an optical sensor, and a controller. The industrial equipment has a fluid inlet, a fluid outlet, and contains soil. The fluid pump is connected to a pre-rinse fluid source and configured to pressurize the pre-rinse fluid and convey the pre-rinse fluid through the industrial equipment from the fluid inlet to the fluid outlet. The optical sensor receives pre-rinse fluid discharged through the fluid outlet of the industrial equipment and fluorometrically analyzes the pre-rinse fluid. The controller receives fluorometric data from the optical sensor and determines therefrom a concentration of the soil in the pre-rinse fluid. The controller in this example also controls a flow of the pre-rinse fluid through the industrial equipment based on the determined concentration of the soil.

The details of one or more examples are set forth in the accompanying drawings and the description below. Other features, objects, and advantages will be apparent from the description and drawings, and from the claims.

DETAILED DESCRIPTION

The present disclosure is generally directed to systems, devices, and techniques for cleaning of industrial equipment using a clean-in-place (CIP) process. Initially during the process, a pre-rinse fluid is passed under pressure through the industrial equipment to flush the equipment of soil. The term soil as used herein generally refers to the component or components intended to be cleaned from the industrial equipment during the CIP process. Soil may include residual product being flushed from the equipment, built-up product in the equipment (e.g., baked-on product), and/or contaminants in the equipment, among other types of soils. Pre-rinse fluid passing through the processing equipment can pick up soil as the fluid flushes the soil from the equipment. Increasing the extent or duration of the pre-rinse flushing process can increase the amount of soil flushed from the equipment. This can be beneficial to reduce the amount of soil remaining in the equipment for a subsequent cleaning step. However, because cleaning fluid passing through the equipment during the cleaning step is typically recirculated whereas pre-rinse fluid is typically disposed to drain, too much pre-rinse flushing can be wasteful of time and pre-rinse flushing fluid.

In accordance with some examples described in this disclosure, pre-rinse fluid passing through industrial equipment is fluorometrically analyzed to determine a concentration of soil in the fluid. The soil itself may emit fluorescent emissions in response to receiving an appropriate wavelength of light. When this occurs, a concentration of soil in the pre-rinse fluid may be determined directly from the fluorescent emissions of the soil without adding an artificial fluorescent tracer molecule to the pre-rinse fluid. With knowledge of the concentration of the soil in the pre-rinse fluid exiting the industrial equipment, the equipment can be flushed until the concentration falls below a level indicating that pre-rinsing is no longer efficient for the particular application.

Figure 1:
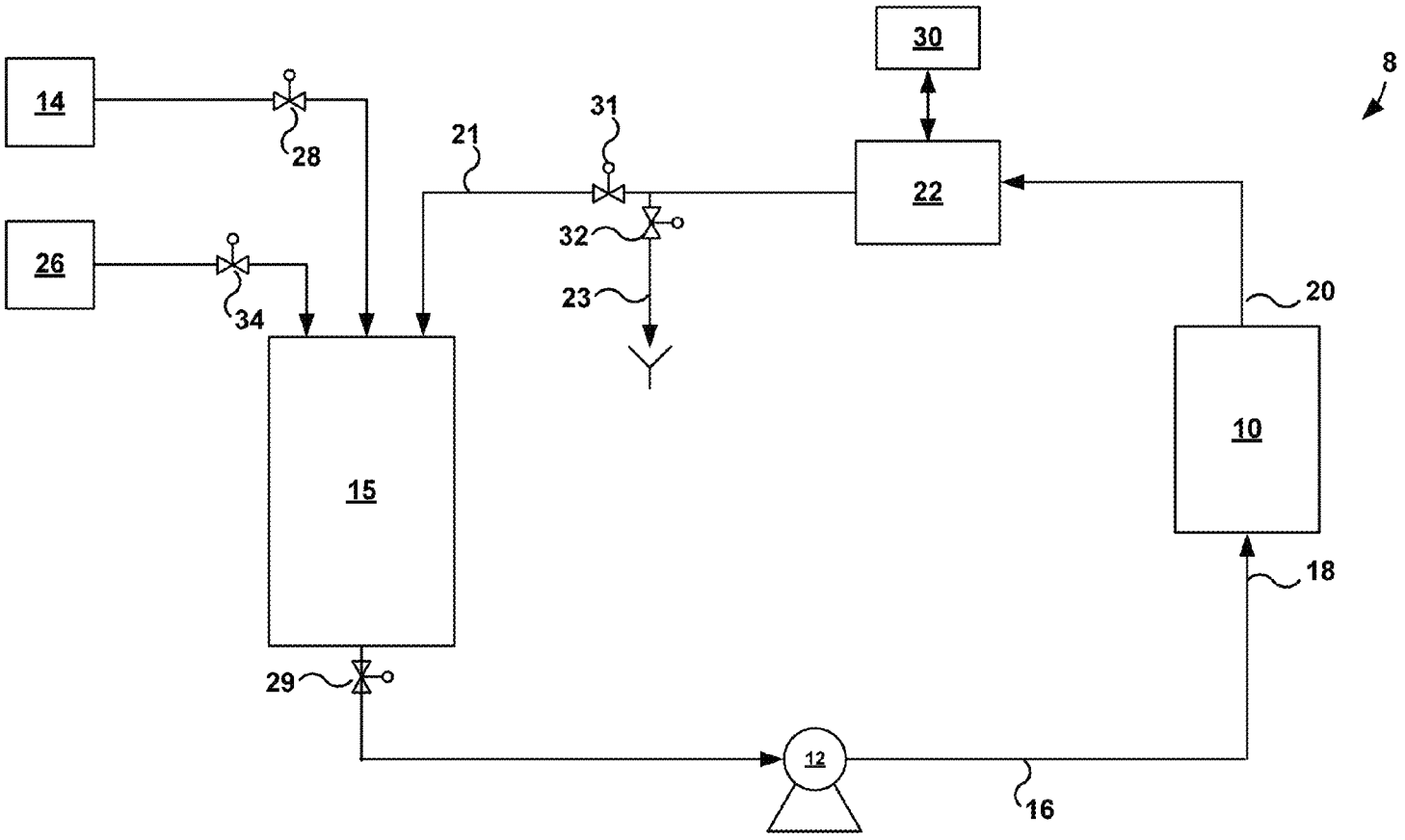
FIG. 1 is an illustration of an example clean-in-place (CIP) system.

FIG. 1 is an illustration of an example CIP system 8 in which industrial equipment 10 is cleaned in place. System 8 includes a pump 12 fluidly connected to a source of pre-rinse fluid 14 via a tank 15. Tank 15 fills with pre-rinse fluid and provides a reservoir of fluid from which pump 12 can draw. Pump 12 draws pre-rinse fluid 14 at a suction side of the pump, pressurizes the fluid inside of the pump, and discharges the fluid at an elevated pressure into fluid conduit 16. Fluid conduit 16 is connected to a fluid inlet 18 of equipment 10 and conveys pressured fluid from the pump to the equipment. Inside of the industrial equipment 10, pre-rinse fluid 14 can flush soil from internal surfaces of the equipment so that pre-rinse fluid exiting fluid outlet 20 of the equipment contains soil. An optical sensor 22 receives pre-rinse fluid containing soil from fluid outlet 20 and optically analyzes the fluid, e.g., to determine a concentration of soil in the fluid. Fluid exiting industrial equipment 10 during a CIP process can either be returned to tank 15 via conduit 21 for recirculation or be disposed of to drain via a conduit 23.

CIP system 8 in FIG. 1 also includes a source of concentrated cleaning and/or sanitizing chemical 26 that is fluidly connected to tank 15. During a cleaning step of the CIP process following the pre-rinse step, the concentrated chemical may be dispensed into tank 15. In examples in which pre-rinse fluid 14 is water, the water source may also be fluidly connected to tank 15 to introduce water into the tank for generating a dilute chemical fluid from concentrated chemical 26. In operation, pump 12 can draw liquid cleaning fluid from tank 15, pressurize the fluid, and convey the cleaning fluid through industrial equipment 10. Typically, the cleaning fluid containing cleaning and/or sanitizing agent is recirculated through industrial equipment 10 via conduit 21 for a period of time or a number of recirculation cycles before being disposed of to drain via conduit 23.

CIP system 8 also includes an assortment of valves (28, 29, 31, 32, 34) and fluid conduits that control fluid movement through the system. A controller 30 manages the overall operation of CIP system 8. Controller 30 may be communicatively coupled to various components within CIP system 8, for example via a wired or wireless connection, so as to send and receive electronic control signals and information between controller 30 and the communicatively coupled components. For example, controller 30 may electronically actuate valves (28, 29, 31, 32, 34) to open/close the valves and control pump 12 to control fluid movement through the system. Controller 30 can also control optical sensor 22 to optically analyze fluid exiting equipment 10 and to determine a concentration of soil therein.

Although FIG. 1 illustrates one particular arrangement of a CIP system, is should be understood that this is only one example. The disclosure is not limited to a CIP system having any particular configuration, much less the particular configuration of FIG. 1. In different examples, CIP system 8 may not include tank 15 or may include multiple tanks, e.g., where one tank holds pre-rinse and/or rinse fluid and a separate tank holds cleaning fluid. As another example, CIP system 8 may include a heat exchanger, heater, and/or cooler to adjust the temperature of fluids used during the CIP cleaning process. CIP system 8 can include additional or different features, as will be appreciated by those of ordinary skill in the art.

Industrial equipment 10 may at various times during a CIP cleaning process be flushed with pre-rinse fluid, cleaning fluid, and rinse fluid. Pre-rinse fluid may be a fluid that functions to rinse soil from within industrial equipment 10, helping to eliminate soil residues within the equipment and prepare the equipment for subsequent flushing with a cleaning fluid. Pre-rinse fluid is typically water (e.g., may consist or consist essentially of water), although other suitable pre-rinse fluids may be used depending on the application. When pre-rinse fluid is water, the water may be supplied as fresh water from a pressurized water main or may be reused from a different process at the location of industrial equipment 10 (e.g., condenser water). In some examples, pre-rinse fluid is passed through industrial equipment 10 only a single time before being discarded to drain via conduit 23. In other examples, the pre-rinse fluid is recirculated through CIP system 8 via conduit 21 so the fluid passes through tank 15, pump 12, and industrial equipment 10 multiple times. During each successive pass through the industrial equipment, the pre-rinse fluid may release more soil from the industrial equipment. Recirculating pre-rinse fluid through industrial equipment 10 can help conserve the amount of fluid consumed during the pre-rinse process. Independent of whether the pre-rinse fluid is recirculated through industrial equipment 10 or passed through the equipment only a single time, the fluid may be discarded to drain at the end of the pre-flushing step.

Cleaning fluid used to clean industrial equipment 10 is generated from concentrated chemical 26. Under the control of controller 30, a target amount of concentrated chemical 26 is dispensed into tank 15 along with a target amount of water to generate a dilute cleaning fluid that is flushed through industrial equipment 10. Concentrated chemical 26 may contain a cleaning agent, a sanitizing agent, or a combination of different agents. For example, concentrated chemical 26 may be, but is not limited to, an alkaline source (e.g., sodium hydroxide, potassium hydroxide), triethanol amine, diethanol amine, monoethanol amine, sodium carbonate, morpholine, sodium metasilicate, potassium silicate, an acid source, a mineral acid (e.g., phosphoric acid, sulfuric acid), an organic acid (e.g., lactic acid, acetic acid, hydroxyacetic acid, citric acid, glutamic acid, glutaric acid, gluconic acid). In addition, although CIP system 8 is illustrated as only having a single concentrated chemical 26, in other examples, the system may include multiple concentrated chemicals that are used either alone or in combination.

For example, CIP system 8 may include a first concentrated chemical that is an alkaline detergent and a second concentrated chemical that is an acidic detergent. Controller 30 may initially combine the alkaline detergent with water in tank 15 and pass the alkaline detergent through industrial equipment 10. The alkaline detergent may help dissolve fat, proteins, and hard deposits, among other components. An intermediate water rinse may or may not be performed on the equipment after the alkaline detergent wash. Subsequently, controller 30 may combine the acidic detergent with water in tank 15 and pass the acidic detergent through industrial equipment 10. The acidic detergent may remove mineral deposits from the equipment and neutralize remaining alkaline detergent on the surfaces of the equipment.

Rinse fluid used in CIP system 8 is typically water, although other suitable fluids can be used. Following a cleaning step of a CIP process, the rinse fluid can be passed through industrial equipment 10 to flush the equipment of any residual chemical agent remaining in the equipment. This can prepare the industrial equipment to again process product. In some examples, rinse fluid is passed through industrial equipment 10 only a single time before being discarded to drain via conduit 23. In other examples, the rinse fluid is recirculated through CIP system 8 via conduit 21 multiple times before being discarded to drain.

To initiate a CIP cleaning process, controller 30 may receive a CIP request requesting that a CIP cleaning procedure be performed on industrial equipment 10. In response to the request, controller 30 can control CIP system 8 to initiate a sequence of cleaning steps on industrial equipment 10. For example, controller 30 can initiate a pre-rinse step by opening valve 28 to fill tank 15 with water. When the tank is suitably filled, controller 30 can open valve 29 and activate pump 12 to draw the water from the tank and push pressurized water through industrial equipment 10. As the water contacts internal surfaces of industrial equipment 10, the water may flush soil from the industrial equipment. In different examples, controller 30 opens either valve 31 or 32 to direct the water back to tank 15 or to a drain. At the end of the pre-rinse step, controller 30 may close valves 28, 29, 31 and/or 32 and stop pump 12.

Following the pre-rinse step, controller 30 may initiate a cleaning step by opening valve 34 to dispense concentrated chemical 26 into tank 15 and opening valve 28 to dispense water into the tank. When the tank is suitably filled with a cleaning fluid generated from the concentrated chemical and water, controller 30 can open valve 29 and activate pump 12 to draw the cleaning fluid from the tank and push pressurized cleaning fluid through industrial equipment 10. As the cleaning fluid contacts internal surfaces of industrial equipment 10, the cleaning fluid may clean soil from the surfaces of the industrial equipment, sanitize the surfaces, and the like. Typically, controller 30 opens valve 31 to direct the cleaning solution exiting industrial equipment 10 back into tank 15. Within tank 15, the returned cleaning fluid may be blended with flesh concentrated chemical 26 and/or water and then discharged for recirculation via pump 12 through industrial equipment 10. At the end of the cleaning step, controller 30 may open valve 32 to discharge the cleaning fluid to drain, stop pump 12, and close valves 28, 29, 31, 32, and/or 34.

With the cleaning step complete, controller 30 may initiate a rinse step by opening valve 28 to fill tank 15 with water. When the tank is suitably filled, controller 30 can open valve 29 and activate pump 12 to draw the water from the tank and push pressurized water through industrial equipment 10. As the water contacts internal surfaces of industrial equipment 10, the water may flush cleaning fluid and any remaining soil from the industrial equipment. Controller 30 may recirculate the water to tank 15 by opening valve 31 or discharge the water to drain by opening valve 32. At the end of the rinse step, controller 30 may close valves 28, 29, 31 and/or 32 and stop pump 12. In this manner, controller 30 may control CIP system 8 to perform a series of cleaning steps to clean industrial equipment 10 without disassembling or removing the equipment from its location of normal operation. It should be appreciated, however, that the foregoing description of a CIP cleaning process is merely one example and different CIP cleaning processes may be used. For instance, in some applications, the rinse step is omitted from the CIP cleaning process, e.g., to prevent contamination of the equipment with bacteria following the cleaning step.

CIP system 8 includes optical sensor 22. Optical sensor 22 is configured to optically analyze fluid exiting industrial equipment 10 in CIP system 8. As discussed in greater detail with respect to FIG. 2, optical sensor 22 may receive a sample of fluid discharged from industrial equipment 10 during a CIP cleaning process, direct light into the fluid to generate fluorescent emissions from soil (if any) in the fluid, and detect the fluorescent emissions emitted by the fluid. The fluorescent emissions may be proportional to the concentration of soil in the fluid. Accordingly, controller 30 may determine a concentration of soil in the fluid based on data generated by optical sensor 22. Controller 30 may further control the CIP cleaning process based on the determined concentration of soil in the fluid.

Optical sensor 22 may be implemented in a number of different ways in CIP system 8. In the example shown in FIG. 1, optical sensor 22 is positioned in-line with a fluid conduit exiting industrial equipment 10 to determine a concentration of soil in fluid flowing through the fluid conduit. In other examples, a sample line may be connected to a main conduit exiting industrial equipment 10. In such examples, the sample line can fluidly connect optical sensor 22 to the main fluid conduit. As fluid moves through the main fluid conduit, a portion of the fluid may enter the sample line and pass adjacent an optical sensor head of the sensor, thereby allowing optical sensor 22 to determine a concentration of soil in the fluid flowing through the main fluid conduit. When implemented to receive fluid continuously, optical sensor 22 may be characterized as an online optical sensor. In other examples, optical sensor 22 may be implemented as an offline optical sensor that receives fluid on an intermittent basis, e.g., by manually filling the optical sensor with fluid.

In one example, optical sensor 22 receives pre-rinse fluid exiting industrial equipment 10 via fluid outlet 20 during a pre-rinse step. Optical sensor 22 optically analyzes the pre-rinse fluid by directing light into the fluid to cause soil in the pre-rinse fluid to excite and emit fluorescent energy. Optical sensor 22 detects the fluorescent energy and generates therefrom an optical sensor output proportional to the amount and/or wavelength of the fluorescent energy detected. Controller 30 receives the optical sensor output and determines a concentration of soil in the pre-rinse fluid based on the output. From this information, controller 30 may control the pre-rinse fluid, for example, by increasing or decreasing the rate at which pump 12 pumps the fluid through industrial equipment 10, starting pump 12, or stopping pump 12 and closing valves 28, 29 to terminate the pre-rinse step.

A CIP request received by controller 30 that requests initiation of a CIP process may be entered via a user interface or may be stored in a memory associated with the controller. For example, CIP system 8 may include a user interface that presents a variety of preprogrammed CIP cleaning options from which a user may select (e.g., a menu of preprogrammed CIP cleaning processes). As another example, the user interface may permit the user to enter parameters for generating a customized CIP cleaning step. Parameters specified by the user via the user interface may relate to the intensity of the cleaning process performed by the CIP system. For example, a user may select a flow rate at which pump 12 pumps fluid through industrial equipment 10 at each step of the CIP process, a duration (e.g., in time or amount of fluid) that the pump pumps fluid through the equipment at each step of the process, a concentration of chemical(s) used in the cleaning fluid, whether and when fluid is recirculated or discharged to drain during the process, and/or a temperature of the fluid pumped through the equipment. Additionally, a user may specify concentration values (e.g., limits and/or ranges) for soil which, when detected by optical detector 22, cause controller 30 to electronically control CIP system 8 (e.g., by stopping pump 12, adjusting a rate of the pump, stopping a pre-rinse step and beginning a cleaning step, stopping a rinse step). In still other examples, CIP system 8 may be programmed to automatically initiate a CIP cleaning process at prescheduled times or at periodic intervals. Based on information stored in a memory associated with controller 30, the controller can control the various valve(s) and pump(s) in the system to conduct a CIP cleaning process.

CIP system 8 is configured to clean industrial equipment 10. Industrial equipment 10 is conceptually illustrated on FIG. 1 as a single module having an inlet 18 and an outlet 20. The depiction of industrial equipment 10 as a single module is for purposes of illustration and discussion only. It is contemplated that industrial equipment 10 may include one or more individual pieces of industrial equipment (e.g., two, three, four, or more) that each includes an inlet where fluid enters and an outlet where fluid exits. Multiple pieces of industrial equipment can be connected in series to provide a fluid circuit through which fluid travels from one piece of industrial equipment to another piece of industrial equipment. In some examples, industrial equipment 10 defines multiple fluid circuits that each have multiple pieces of industrial equipment connected in series. In such examples, CIP system 8 may have separate pumps and/or fluid conduits fluidly connecting the different fluid circuits to the CIP system 8. Additionally, CIP system 8 may have a fluid/valve manifold to separately connect each of the different fluid circuits to the CIP system.

Examples of individual pieces of industrial equipment 10 include evaporators, separators, fermentation tanks, aging tanks, liquid storage tanks, mash vessels, mixers, pressurized and non-pressurized reactors, driers, heat exchangers. Industrial equipment 10 can also include flow equipment that provides a mechanism for transporting and/or directing a material that is processed, stored, and/or produced during normal operation of the equipment. For example, the flow equipment may include delivery lines, valves, valve clusters, valve manifolds, restrictors, transfer lines (e.g., pipes, conduits), orifices, and pumps.

CIP system 8 is generally located within an industrial plant that processes a product. The industrial plant may provide for the processing, storage, and/or production of various end products. Exemplary industries that may use CIP system 8 include the food industry, the beverage industry, the pharmaceutical industry, the chemical industry, and the water purification industry. In the case of the food and beverage industry, products processed by industrial equipment 10 (and hence the source of soil remaining in the equipment) can include, but is not limited to, dairy products such as whole and skimmed milk, condensed milk, whey and whey derivatives, buttermilk, proteins, lactose solutions, and lactic acid; protein solutions such as soya whey, nutrient yeast and fodder yeast, and whole egg; fruit juices such as orange and other citrus juices, apple juice and other pomaceous juices, red berry juice, coconut milk, and tropical fruit juices; vegetable juices such as tomato juice, beetroot juice, carrot juice, and grass juice; starch products such as glucose, dextrose, fructose, isomerose, maltose, starch syrup, and dextrine; sugars such as liquid sugar, white refined sugar, sweetwater, and insulin; extracts such as coffee and tea extracts, hop extract, malt extract, yeast extract, pectin, and meat and bone extracts; hydrolyzates such as whey hydrolyzate, soup seasonings, milk hydrolyzate, and protein hydrolyzate; beer such as de-alcoholized beer and wort; baby food, egg whites, bean oils, and fermented liquors.

The composition of the soil being cleaned from industrial equipment 10 will vary depending on the application of the industrial equipment. In general, the soil will include some or all of the product(s) most recently processed on industrial equipment 10 prior to initiating the CIP cleaning process. When industrial equipment 10 provides a heated surface (e.g., a heat exchanger, evaporator), the soil may include a thermally degraded rendering of the product(s) most recently processed on the industrial equipment. Example soils may include a carbohydrate, a proteinaceous matter, food oil, cellulosics, monosaccharides, disaccharides, oligosaccharides, starches, gums, proteins, fats, and oils. In some examples, a soil includes a polycyclic compound and/or a benzene molecule that has one or more substituent electron donating groups such as, e.g., —OH, —$NH_2$, and —$OCH_3$, which may exhibit fluorescent characteristics.

Pump 12 in CIP system 8 may be any suitable fluid pressurization device such as a direct lift pump, positive displacement pump, velocity pump, buoyancy pump and/or gravity pump or any combination thereof. In general, components described as valves (28, 29, 31, 32, 34) may be any device that regulates the flow of a fluid by opening or closing fluid communication through a fluid conduit. In various examples, a valve may be a diaphragm valve, ball valve, check valve, gate valve, slide valve, piston valve, rotary valve, shuttle valve, and/or combinations thereof. Each valve may include an actuator, such as a pneumatic actuator, electrical actuator, hydraulic actuator, or the like. For example, each valve may include a solenoid, piezoelectric element, or similar feature to convent electrical energy received from controller 30 into mechanical energy to mechanically open and close the valve. Each valve may include a limit switch, proximity sensor, or other electromechanical device to provide confirmation that the valve is in an open or closed position, the signals of which are transmitted back to controller 30.

Fluid conduits and fluid lines in CIP system 8 may be pipes or segments of tubing that allow fluid to be conveyed from one location to another location in the system. The material used to fabricate the conduits should be chemically compatible with the liquid to be conveyed and, in various examples, may be steel, stainless steel, or a polymer (e.g., polypropylene, polyethylene).

Figure 2:
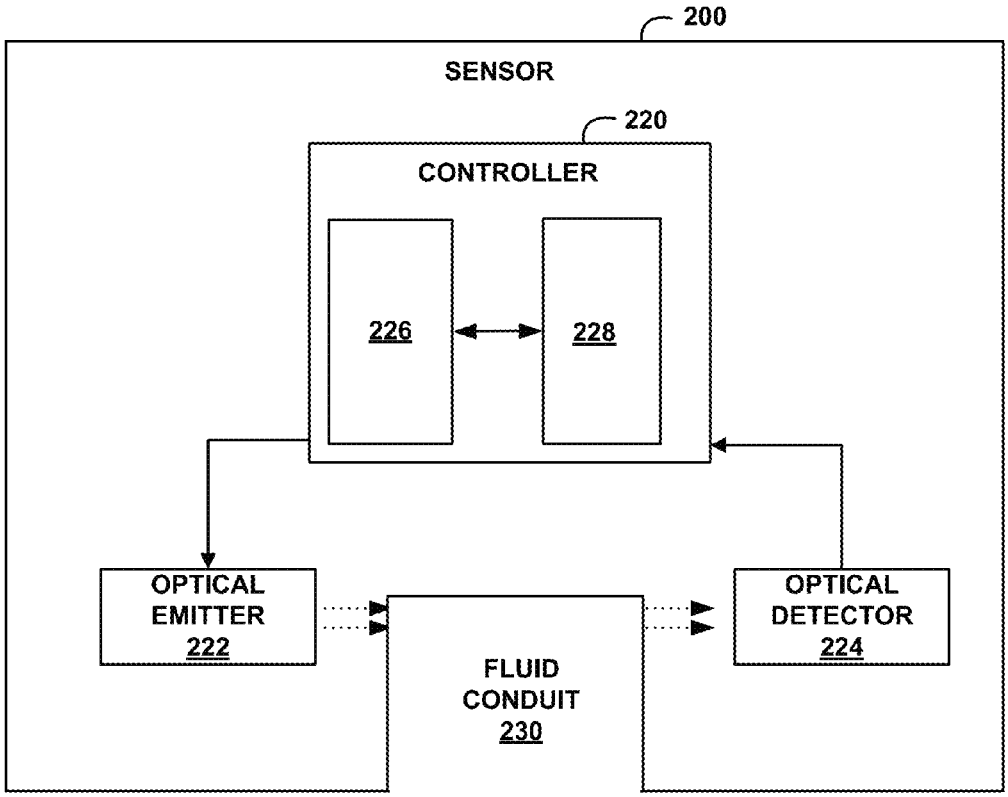
FIG. 2 is a block diagram of an example optical sensor that may be used in the CIP system of FIG. 1.

In the example of FIG. 1, optical sensor 22 optically analyzes fluid passing through industrial equipment 10, e.g., to determine a concentration of soil in the fluid. FIG. 2 is a block diagram illustrating an example of an optical sensor 200 that may be used to optically analyze a fluid from CIP system 8. Sensor 200 may be used as optical sensor 22 in CIP system 8.

With reference to FIG. 2, sensor 200 includes a controller 220, one or more optical emitters 222 (referred to herein as "optical emitter 222"), and one or more optical detectors 224 (referred to herein as "optical detector 224"). Controller 220 (which may be the same as controller 30 in FIG. 1) includes a processor 226 and a memory 228. In operation, optical emitter 222 directs light into fluid (e.g., a pre-rinse fluid containing soil) flowing through fluid conduit 230 and optical detector 224 detects fluorescent emissions generated by the fluid. The light directed into the fluid by optical emitter 222 may generate fluorescent emissions by exciting electrons of fluorescing molecules within the fluid, causing the molecules to emit energy (i.e., fluoresce) that can be detected by optical detector 224. For example, when light is directed into a pre-rinse fluid exiting industrial equipment 10 (FIG. 1) and containing soil, electrons in molecules of the soil may excite, causing the molecules to fluoresce. In some examples, optical emitter 222 directs light at one frequency (e.g., ultraviolet frequency) into fluid flowing through fluid conduit 230 and causes fluorescing molecules to emit light energy at a different frequency (e.g., visible light frequency, a different ultraviolet frequency).

Memory 228 stores software and data used or generated by controller 220. For example, memory 228 may store data used by controller 220 to determine a concentration of one or more chemical components within the fluid being monitored by sensor 200, such as one or more types of soils within a pre-rinse fluid being monitored by the sensor. In some examples, memory 228 stores data in the form of an equation that relates fluorescent emissions detected by optical detector 224 to a concentration of the one or more soils.

Processor 226 runs software stored in memory 228 to perform functions attributed to sensor 200 and controller 220 in this disclosure. Components described as processors within controller 220, controller 30, or any other device described in this disclosure may each include one or more processors, such as one or more microprocessors, digital signal processors (DSPs), application specific integrated circuits (ASICs), field programmable gate arrays (FPGAs), programmable logic circuitry, or the like, either alone or in any suitable combination.

Optical emitter 222 includes at least one optical emitter that emits optical energy into a fluid present with fluid conduit 230. In some examples, optical emitter 222 emits optical energy over a range of wavelengths. In other examples, optical emitter 222 emits optical energy at one or more discrete wavelengths. For example, optical emitter 222 may emit at two, three, four or more discrete wavelengths.

In one example, optical emitter 222 emits light within the ultraviolet (UV) spectrum. Light within the UV spectrum may include wavelengths in the range from approximately 10 nm to approximately 400 nanometers. Light emitted by optical emitter 222 is directed into fluid within fluid conduit 230. In response to receiving the optical energy, fluorescing molecules (e.g., molecules of soil released from industrial equipment 10 by a pre-rinse fluid) within the fluid may excite, causing the molecules to produce fluorescent emissions. The fluorescent emissions, which may or may not be at a different frequency than the energy emitted by optical emitter 222, may be generated as excited electrons within fluorescing molecules change energy states. The energy emitted by the fluorescing molecules may be detected by optical detector 224.

The specific wavelengths at which optical emitter 222 emits light may vary, e.g., depending on the type of soil expected to be flushed from industrial equipment 10 (FIG. 1). In some examples, optical emitter 222 emits light at a frequency of less than 350 nanometers (nm), such as less than 330 nm, or less than 300 nm. For example, optical emitter 222 may emit light in the frequency range of approximately 275 nm to approximately 335. The foregoing wavelengths are merely examples, however, and other wavelengths of light may be used.

Optical emitter 222 may be implemented in a variety of different ways within sensor 200. Optical emitter 222 may include one or more light sources to excite molecules within the fluid. Example light sources include light emitting diodes (LEDS), lasers, and lamps. In some examples, optical emitter 222 includes an optical filter to filter light emitted by the light source. The optical filter may be positioned between the light source and the fluid and be selected to pass light within a certain wavelength range. In some additional examples, the optical emitter includes a collimator, e.g., a collimating lens, hood or reflector, positioned adjacent the light source to collimate the light emitted from the light source. The collimator may reduce the divergence of the light emitted from the light source, reducing optical noise.

Sensor 200 also includes optical detector 224. Optical detector 224 includes at least one optical detector that detects fluorescent emissions emitted by excited molecules within fluid conduit 230. In some examples, optical detector 224 is positioned on a different side of fluid conduit 230 than optical emitter 222. For example, optical detector 224 may be positioned on a side of fluid conduit 230 that is offset approximately 90 degrees relative to optical emitter 222. Such an arrangement may reduce the amount of light that is emitted by optical emitter 222, transmitted through fluid within fluid conduit 230, and detected by optical detector 224. This transmitted light can potentially cause interference with fluorescent emissions detected by the optical detector.

In operation, the amount of optical energy detected by optical detector 224 may depend on the contents of the fluid within fluid conduit 230. If the fluid conduit contains a fluid solution that has certain properties (e.g., a certain concentration of soil), optical detector 224 may detect a certain level of fluorescent energy emitted by the fluid. However, if the fluid solution has different properties (e.g., a different concentration of soil), optical detector 224 may detect a different level of fluorescent energy emitted by the fluid. For example, if fluid conduit 230 is filled with a pre-rinse fluid having a first concentration of soil, optical detector 224 may detect a first magnitude of fluorescent emissions. However, if the fluid conduit is filled with a pre-rinse fluid having a second concentration of soil that is greater than the first concentration, optical detector 224 may detect a second magnitude of fluorescent emissions that is greater than the first magnitude.

Optical detector 224 may also be implemented in a variety of different ways within sensor 200. Optical detector 224 may include one or more photodetectors such as, e.g., photodiodes or photomultipliers, for converting optical signals into electrical signals. In some examples, optical detector 224 includes a lens positioned between the fluid and the photodetector for focusing and/or shaping optical energy received from the fluid.

Controller 220 controls the operation of optical emitter 222 and receives signals concerning the amount of light detected by optical detector 224. In some examples, controller 220 further processes signals, e.g., to determine a concentration of soil within the fluid passing through fluid conduit 230.

In one example, controller 220 controls optical emitter 222 to direct radiation into a fluid containing soil and further controls optical detector 224 to detect fluorescent emissions emitted by the soil within the fluid. Controller 220 then processes the light detection information to determine a concentration of the soil in the fluid. Controller 220 can determine a concentration of the soil by comparing the magnitude of fluorescent emissions detected by optical detector 224 from a fluid having an unknown concentration of the soil to the magnitude of the fluorescent emissions detected by optical detector 224 from a fluid having a known concentration of the soil (e.g., a calibration fluid). In some examples, controller 220 determines concentrations of multiple soils in a fluid based on the magnitude of fluorescent emissions detected by optical detector 224 at different wavelengths.

In response to determining the concentration of soil in the fluid, processor 226 may compare the determined soil concentration to one or more thresholds stored in memory 228, such as one or more concentration thresholds. Controller 220 may be informed of thresholds and the thresholds stored in memory 228, e.g., via user input at a user interface. Thresholds stored in memory 228 may act as a trigger point for controlling CIP system 8 (FIG. 1).

With further reference to FIG. 1, for example, controller 30 may control CIP system 8 until a concentration of soil in a fluid flowing through the system is determined to equal and/or exceed a threshold value stored in memory. In one example, controller 30 controls pump 12 to pump pre-rinse fluid such as fresh water from source 14, through industrial equipment 10, and dispose the pre-rinse fluid to drain via conduit 23. Pre-rinse fluid entering industrial equipment 10 via inlet 18 may be substantially or entirely devoid of soil such that, were the pre-rinse fluid optically analyzed by optical sensor 22, the pre-rinse fluid would not emit fluorescent emissions (e.g., at least from soil). As the pre-rinse fluid passes through industrial equipment 10 and contacts internal surfaces of the equipment, however, the pre-rinse may pick up soil so that, when the pre-rinse fluid is optically analyzed by optical sensor 22, the pre-rinse fluid emits fluorescent emissions proportional to the concentration of soil in the fluid. The concentration of soil in the pre-rinse fluid exiting industrial equipment 10 may be comparatively high at the beginning of the CIP process but may decrease with time as soil is flushed out of the equipment by fresh, incoming pre-rinse fluid. At a certain point in the CIP process, the amount of soil being released by incoming pre-rinse fluid may diminish to a point where it is no longer beneficial to continue the pre-rinse step but instead should be switched over to the cleaning step. Controller 30 may make this determination based on concentration information determined by optical sensor 22 and threshold(s) stored in memory (e.g., memory 228 in FIG. 2).

The specific thresholds stored in memory 228 may depend, e.g., on the characteristics of the soil being cleaned, the cleanliness requirements for the product produced using industrial equipment 10, and the availability of various CIP cleaning fluids. For example, if conservation of pre-rinse fluid is of concern, memory 228 may store a concentration threshold value of a certain magnitude. By contrast, if wash efficiency is of concern, memory 228 may store a concentration threshold value of a lower magnitude, and if heavy soil removal is of concern, memory 228 may store a concentration threshold value of an even lower magnitude. During operation of CIP system 8, controller 30 can control the components of the system to flush industrial equipment 10 with pre-rinse fluid, e.g., until a concentration of soil in the pre-rinse fluid exiting the equipment is determined to be equal to and/or less than the threshold value stored in memory. At this point, controller 30 may control CIP system 8 to terminate the pre-rinse step and begin the cleaning step.

In some examples, controller 30 receives a request specifying an intensity of a CIP cleaning process to be performed on industrial equipment 10, such as an intensity of a pre-rinse step to be performed on the industrial equipment. The request may be entered by a user and/or may be electronically stored in a memory. For example, a user may enter a request specifying an intensity of a pre-rinse step to be performed on industrial equipment 10. As examples, the request may specify that the pre-rinse step be performed to conserve pre-rinse fluid, to conduct an efficient wash, or to remove heavy soil. With reference to threshold(s) corresponding to the requested wash intensity stored in memory, controller 30 may control CIP system 8 to perform the pre-rinse step until pre-rinse fluid exiting industrial equipment 10 is determined to contain a concentration of soil equal to and/or below the threshold.

For conservation of pre-rinse fluid, the threshold stored in memory may be a value within a range from approximately 1,000 parts per million by weight soil to approximately 5,000 parts per million by weight soil (e.g., less than 10,000 parts per million by weight soil); for wash efficiency, the threshold stored in memory may be a value within a range from approximately 500 parts per million by weight soil to approximately 2,000 parts per million by weight soil; for heavy soil removal, the threshold stored in memory may be a value within a range from approximately 10 parts per million by weight soil to approximately 1,000 parts per million by weight soil (e.g., less than 1,500 parts per million by weight soil). When controller 30 determines that the concentration of soil in the pre-rinse fluid equals and/or falls below the threshold, the controller may stop pump 12 and close valve 29 to terminate the pre-flush step. It should be appreciated that the foregoing concentration thresholds are merely examples, and other concentration thresholds are both possible and contemplated.

During operation of CIP system 8, controller 30 may determine a concentration of soil in fluid exiting industrial equipment 10 and compare the determined concentration to a value stored in memory. Based on the comparison, controller 30 may adjust CIP system 8, e.g., until the determined concentration equals, is above, or below the target value. In instances in which controller 30 determines the concentration is above the value, controller may electronically control the system, e.g., by starting pump 12, by continuing to operate the pump at its current rate, or by increasing the rate at which the pump pumps fluid. In instances in which controller 30 determines the concentration is below the value, controller may electronically control the system, e.g., by stopping pump 12 or by decreasing the rate at which the pump pumps fluid.

Soil concentration data determined by optical sensor 22 can be used in a number of additional ways to control CIP system 8. As another example, controller 30 may control the components of CIP system 8 to pump fluid (e.g., pre-rinse fluid, cleaning fluid, rinse fluid) in a recirculating loop from tank 15, through pump 12, industrial equipment 10, and back to tank 15. The concentration of soil in the fluid may increase with each successive pass through industrial equipment 10. When controller 30 determines that a concentration of soil in the fluid equals and/or is above a threshold value stored in memory, the controller may close valve 31 and open valve 32 to stop recirculation and discharge the fluid to drain.

Figure 3:
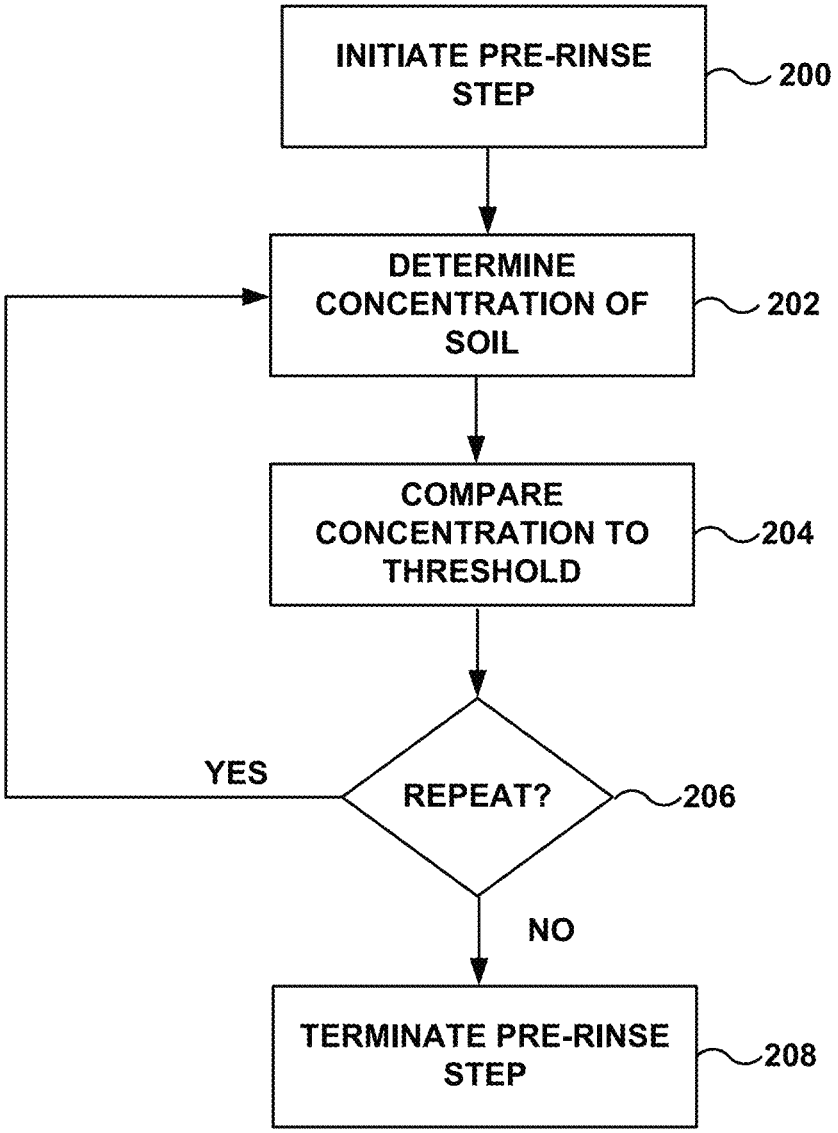
FIG. 3 is a block flow diagram of an example technique for performing a CIP pre-rinse step.

FIG. 3 is a flow chart illustrating an example process for controlling a CIP pre-rinse step. As shown, controller 30 initiates the pre-rinse step by filling tank 15 with pre-rinse fluid and activating pump 12 to pump the fluid through industrial equipment 10 (200). In some examples, the pre-rinse fluid is water that is substantially or entirely devoid of soil. The pre-rinse fluid enters industrial equipment 10 via fluid inlet 18 and discharges from the industrial equipment via fluid outlet 20. Within the industrial equipment, the pre-rinse fluid flows adjacent to and in contact with internal wall surfaces of the equipment, which may release soil from the equipment. When this occurs, the concentration of soil in the pre-rinse fluid is greater at fluid outlet 20 than at fluid inlet 18 (e.g., if there is any soil in the pre-rinse fluid at the inlet).

Optical sensor 22 receives pre-rinse fluid containing soil from industrial equipment 10 and determines a concentration of the soil in the fluid (202). Optical sensor 22 may direct light into the pre-rinse and soil within the fluid may emit fluorescent energy in response to the light. Optical sensor 22 can detect the fluorescent energy and determine a concentration of the soil in the fluid based on the characteristics of the fluorescent energy. For example, optical sensor 22 may determine a concentration of the soil by comparing a magnitude of the fluorescent energy and/or a wavelength of the fluorescent energy to calibration information stored in memory correlating different fluorescent energy characteristics to different soil concentrations.

After determining the concentration of soil in the pre-rinse fluid exiting industrial equipment 10, controller 30 may compare the determined concentration to one or more concentration thresholds stored in memory (204). In different examples, the concentration thresholds may be preprogrammed into memory or may be received from a user via a user interface, e.g., at the start of the CIP cleaning process. Controller 30 may electronically control CIP system 8 until the concentration of soil in the pre-rinse fluid is equal to and/or below a concentration threshold stored in memory (206). For example, controller 30 may continue operating pump 12 to pump fresh pre-rinse fluid through industrial equipment 10 while continuously monitoring the concentration of soil in the fluid exiting the equipment. As soil is removed from the equipment over time, the concentration of soil in the fluid exiting the equipment may decrease.

When controller 30 determines that the concentration of soil in the pre-rinse fluid exiting industrial equipment 10 equals and/or falls below a concentration threshold, the controller can stop pump 12 and close valve 29 to stop the pre-rinse cycle (208). Controller 30 may subsequently control CIP system 8 to perform a CIP cleaning step and/or CIP flush step on industrial equipment 10. Controller 30 may or may not also control the CIP cleaning step and/or CIP flush step by detecting a concentration of soil in fluid during each respective step via optical sensor 22 and performing the respective step until the concentration equals, rises above, and/or falls below a concentration threshold.

The techniques described in this disclosure, including functions performed by a controller, control unit, or control system, may be implemented within one or more of a general purpose microprocessor, digital signal processor (DSP), application specific integrated circuit (ASIC), field programmable gate array (FPGA), programmable logic devices (PLDs), or other equivalent logic devices. Accordingly, the terms "processor" or "controller," as used herein, may refer to any one or more of the foregoing structures or any other structure suitable for implementation of the techniques described herein.

The various components illustrated herein may be realized by any suitable combination of hardware, software, firmware. In the figures, various components are depicted as separate units or modules. However, all or several of the various components described with reference to these figures may be integrated into combined units or modules within common hardware, firmware, and/or software. Accordingly, the representation of features as components, units or modules is intended to highlight particular functional features for ease of illustration, and does not necessarily require realization of such features by separate hardware, firmware, or software components. In some cases, various units may be implemented as programmable processes performed by one or more processors or controllers.

Any features described herein as modules, devices, or components may be implemented together in an integrated logic device or separately as discrete but interoperable logic devices. In various aspects, such components may be formed at least in part as one or more integrated circuit devices, which may be referred to collectively as an integrated circuit device, such as an integrated circuit chip or chipset. Such circuitry may be provided in a single integrated circuit chip device or in multiple, interoperable integrated circuit chip devices.

If implemented in part by software, the techniques may be realized at least in part by a computer-readable data storage medium (e.g., a non-transitory computer-readable storage medium) comprising code with instructions that, when executed by one or more processors or controllers, performs one or more of the methods and functions described in this disclosure. The computer-readable storage medium may form part of a computer program product, which may include packaging materials. The computer-readable medium may comprise random access memory (RAM) such as synchronous dynamic random access memory (SDRAM), read-only memory (ROM), non-volatile random access memory (NVRAM), electrically erasable programmable read-only memory (EEPROM), embedded dynamic random access memory (eDRAM), static random access memory (SRAM), flash memory, magnetic or optical data storage media. Any software that is utilized may be executed by one or more processors, such as one or more DSP's, general purpose microprocessors, ASIC's, FPGA's, or other equivalent integrated or discrete logic circuitry.

The following example may provide additional details about CIP systems and techniques in accordance with this disclosure.

EXAMPLE 1

A variety of water-based solutions containing soil were created and optically analyzed to evaluate the efficacy of using an optical sensor to monitor and control a CIP cleaning process. For the examples, liquid beverages were selected as the example soils and water was selected as the example pre-rinse fluid. Each liquid beverage tested was diluted with water down to a concentration of 500 parts per million. The samples were subsequently fluorometrically analyzed by emitting light into the fluid samples and generating and detecting fluorescent emissions from the soils.

Figure 4:
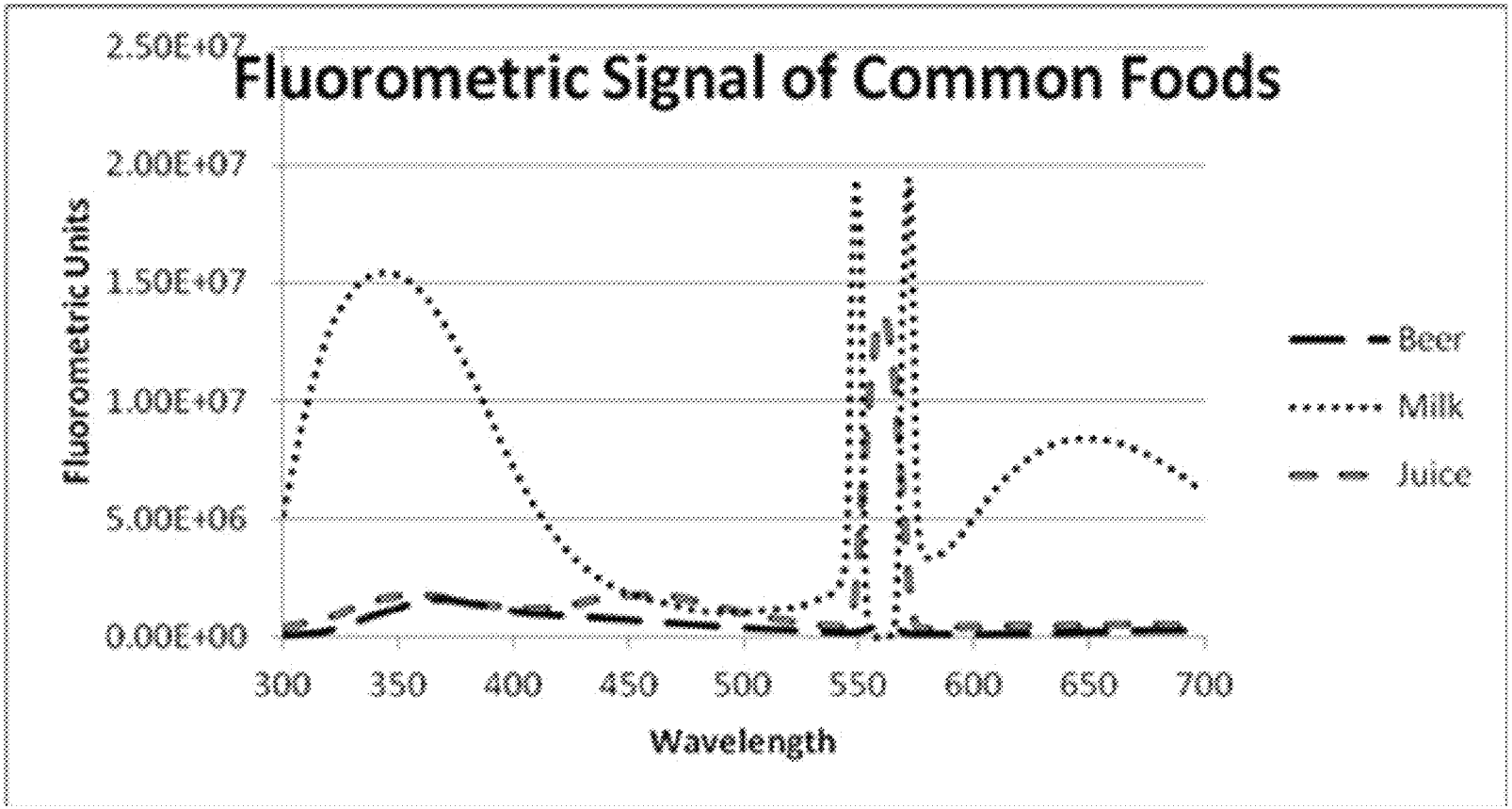
FIG. 4 is a plot showing example optical responses of different example soil materials.
Figure 5:
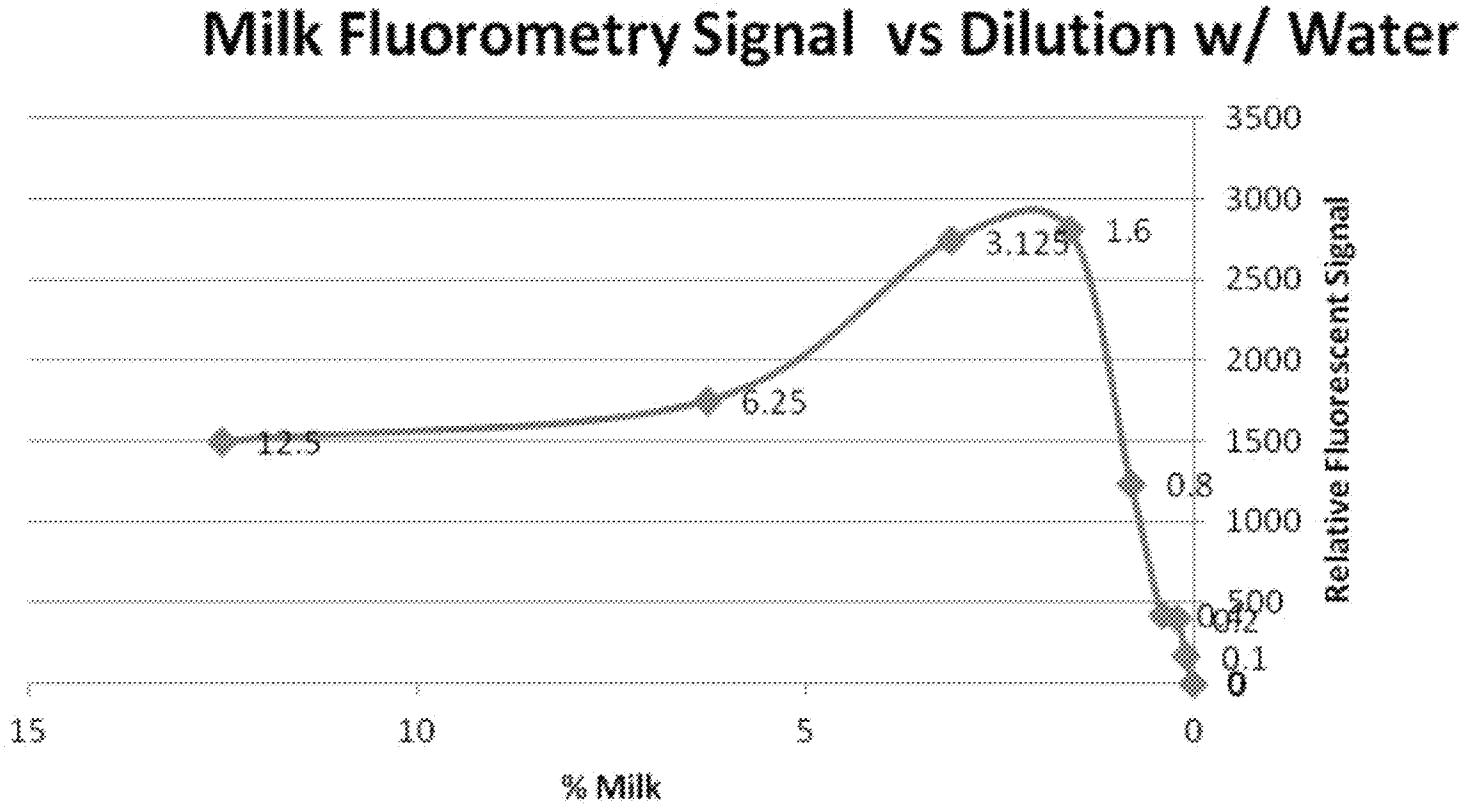
FIG. 5 is a plot showing example optical responses for several milk solutions having different concentrations of milk.

FIG. 4 is a plot showing the optical response of the fluids when light at a wavelength ranging from 280 nanometers to 335 nanometers was emitted into the fluids. The x-axis of the plot is the wavelength of light emitted by the soils in the fluids in response to directing light into the fluids. The y-axis of the plot is the magnitude of light detected at each respective wavelength. The water used to dilute the example soils did not generate any fluorescent emissions in response to directing light into the fluid, indicating the optical response shown in FIG. 4 is from the soil alone and not the background water.

EXAMPLE 2

Several water-based solutions containing different concentrations of milk as a soil were created and optically analyzed to evaluate the efficacy of using an optical sensor to monitor different soil concentrations during a CIP cleaning process. The samples were subsequently fluorometrically analyzed by emitting light into the fluid samples and generating and detecting fluorescent emissions from the soils. FIG. 6 is a plot showing the optical response of the milk solutions when light at a wavelength of 280 nanometers was emitted into the solutions. The x-axis of the plot is concentration of milk in the solutions by weight percent. The y-axis of the plot is the magnitude of light detected at 340 nm for the different solutions. For this example, the optical response of the milk solutions was linear from a concentration of approximately 1.6 percent down to approximately 0 percent, indicating that the concentration range may provide a good range for defining a pre-rinse end point.

The invention claimed is:

1. A method comprising:

flushing industrial equipment with a pre-rinse fluid during a clean-in-place (CIP) process so as to remove soil from the industrial equipment; wherein the pre-rinse fluid is liquid water;

fluorometrically analyzing the pre-rinse fluid exiting the industrial equipment to determine a concentration of the soil in the pre-rinse fluid, and subsequent to flushing the industrial equipment with the pre-rinse fluid, flushing the industrial equipment with a cleaning fluid containing a chemical agent configured to clean the industrial equipment.

2. The method of claim 1, wherein fluorometrically analyzing the pre-rinse fluid comprises generating fluorescent emissions from the soil.

3. The method of claim 1, further comprising electronically controlling a pre-flush step of the CIP process based on the determined concentration of the soil by at least one of adjusting a rate at which the pre-rinse fluid is flushed through the industrial equipment, starting a flow of the pre-rinse fluid through the industrial equipment, and stopping the flow of the pre-rinse fluid through the industrial equipment.

4. The method of claim 3, wherein electronically controlling the pre-flush step of the CIP process based on the determined concentration comprises stopping the flow of the pre-rinse fluid when the determined concentration falls below a threshold value.

5. The method of claim 4, further comprising receiving a request specifying an intensity of the pre-rinse step and determining the threshold value based on the pre-rinse request.

6. The method of claim 5, wherein, when the intensity of the pre-rinse step corresponds to heavy soil removal, the threshold value is less than 1500 parts per million soil in the pre-rinse fluid, and when the intensity of the pre-rinse step corresponds to water savings, the threshold value is less than 10,000 parts per million soil in the pre-rinse fluid.

7. The method of claim 1, wherein fluorometrically analyzing the pre-rinse fluid comprises:

receiving the pre-rinse fluid from a conduit fluidly connected to the industrial equipment;

directing light into the pre-rinse fluid to generate fluorescent emissions from the soil in the pre-rinse fluid; and detecting the fluorescent emissions emitted by the soil.

8. The method of claim 7, wherein emitting light into the fluid medium comprises emitting light at a wavelength of less than approximately 350 nanometers (nm), and detecting the fluorescent emissions comprises detecting light at a wavelength greater than approximately 300 nm.

9. The method of claim 7, wherein fluorometrically analyzing the pre-rinse fluid exiting the industrial equipment to determine a concentration of the soil comprises determining the concentration of the soil based on a magnitude of the fluorescent emissions detected.

10. The method of claim 1, wherein the industrial equipment comprises a tank, a pipe, a filter, or a valve.

11. The method of claim 1, wherein the soil comprises a protein, a carbohydrate, or a fat.

12. The method of claim 1, further comprising:

subsequent to flushing the industrial equipment with the cleaning liquid, flushing the industrial equipment with a rinse fluid to rinse the chemical agent from the industrial equipment.

13. A method comprising:

performing a clean-in-place (CIP) pre-rinse by flushing equipment with water and thereby removing residual product previously processed on the equipment;

fluorometrically analyzing the water exiting the equipment to determine a concentration of the residual product in the water;

controlling the CIP pre-rinse based on the determined concentration of the residual product, and subsequent to performing the CIP pre-rinse, performing a CIP cleaning step by flushing the equipment with a cleaning fluid containing a chemical agent configured to clean the equipment.

14. The method of claim 13, further comprising:

subsequent to performing the CIP cleaning step, performing a CIP rinse step by flushing the equipment with water and thereby removing the cleaning fluid from the equipment.

15. The method of claim 13, wherein the equipment is heated during operation and the residual product comprises a thermally degraded rendering of product previously processed on the equipment.

16. The method of claim 13, wherein the residual product is selected from the group consisting of a food and a beverage.

17. The method of claim 13, wherein the residual product is one of a fermented liquid and a dairy liquid.

18. The method of claim 13, wherein controlling the CIP pre-rinse comprises at least one of adjusting a rate at which the water is flushed through the equipment, starting a flow of the water through the equipment, and stopping the flow of the water through the equipment.

* * * * *